United States Patent [19]

Klann

[11] Patent Number: 4,704,937

[45] Date of Patent: Nov. 10, 1987

[54] PIPE ORGAN VALVE

[76] Inventor: Paul A. Klann, P.O. Box 2398, Waynesboro, Va. 22981

[21] Appl. No.: 934,971

[22] Filed: Nov. 25, 1986

[51] Int. Cl.[4] ..... G10B 3/06

[52] U.S. Cl. ..... 84/339; 84/60

[58] Field of Search ..... 84/60–63, 84/333–345, 368

[56] References Cited

U.S. PATENT DOCUMENTS

| | | | |
|---|---|---|---|
| 1,255,090 | 1/1918 | Gally | 84/60 |
| 1,260,248 | 3/1918 | Stanhope | 84/60 |
| 1,403,930 | 1/1922 | Wick | 84/339 |
| 4,651,615 | 3/1987 | Klann | 84/339 |

*Primary Examiner*—Lawrence R. Franklin

*Attorney, Agent, or Firm*—Sughrue, Mion, Zinn, Macpeak & Seas

[57] ABSTRACT

The pipe organ valve is comprised of a soft flexible membrane in the form of a disk adapted to be secured to a suitable actuator such as the armature of a solenoid adjacent the center of the disk and a semi-rigid ring member secured to the perimeter of the disk to maintain the disk taut while permitting flexing of the ring transversely to the plane of the ring and permitting distortion of the ring member from its normal plane. The valve member is a light weight composite of a disk of soft flexible resilient leather and a disk of woven material bonded together. The pipe organ valve may be mounted adjacent the air passage of a wind chest with the center of the disk off set from the axis of the air passage whereby one portion of the periphery of the valve member will separate from the valve seat prior to the remainder of the periphery.

12 Claims, 7 Drawing Figures

FIG. 1
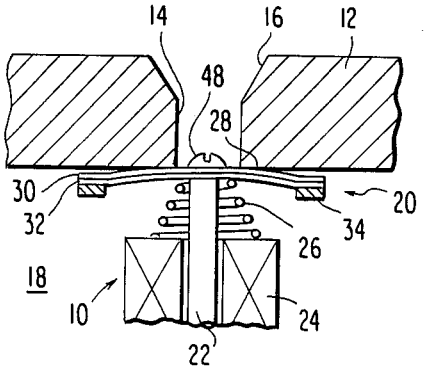
FIG. 2
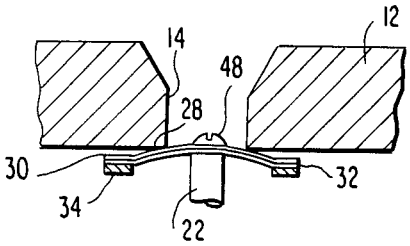
FIG. 3
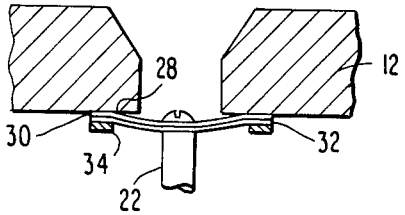
FIG. 4
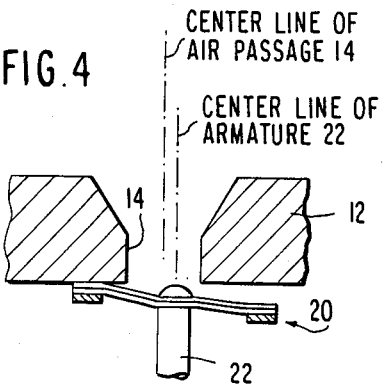
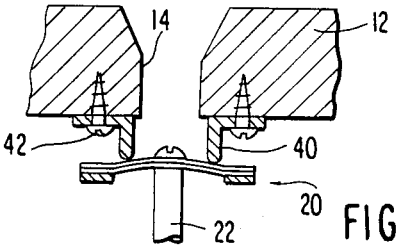
FIG. 5a
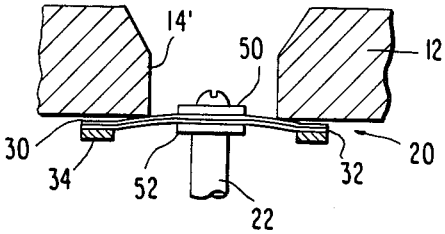
FIG. 6
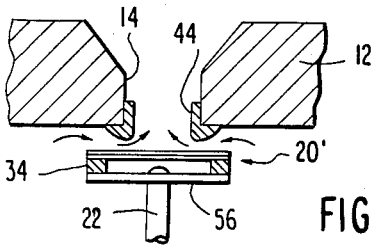
FIG. 5b

PIPE ORGAN VALVE

BACKGROUND OF THE INVENTION

The present invention is directed to a pipe organ valve and more specifically to the construction of the valve member per se adapted to close the wind chest aperture leading to a pipe of the organ.

For many years the typical solenoid operated chest valve for a pipe organ was provided with a valve member of soft resilient material in order to minimize the noise upon closing of the valve. The valve was usually attached to a valve stem which acted as the armature of the solenoid and a closing spring generally surrounded the valve stem for normally biasing the valve member into closing engagement with the wind chest about the circumference of the aperture leading to a pipe. The spring had to be of sufficient strength so as cause a fast return of the valve but not so strong as to resist the attraction of the solenoid when it was necessary to open the valve to allow the pipe to speak.

The combined mass of the valve and stem, the spring force, the pressure differential between the interior of the chest and the atmosphere and the resiliency of the material used in the valve all combined to plague the valve with an unacceptable tendency to bounce during a closing operation. This was even more objectionable on fast speaking pipes since a very audible sound was produced with the air escaping into the pipe as the valve member bounced.

In Applicant's prior U.S. Pat. No. 3,967,522, granted July 6, 1976, a solenoid operated chest valve for a pipe organ was disclosed wherein the valve member was constructed so as to minimize the objectionable flow of air into a pipe during bounce to substantially eliminate the objectionable sound previously caused by air escaping into the pipe from the air chest during the bounce of the valve member. The valve member was provided with a flat planar surface adapted to engage the interior of the wind chest about the circumference of an aperture leading to a pipe and was further provided with a circular projection on this surface having minimal circumferential clearance within the aperture so as to allow the projection to move freely within the aperture while substantially filling the aperture during a typical bounce of the main valve member from its seat during a closing operation. While this construction reduced the amount of air flowing during bounce it did not completely eliminate the flow of air and consequently the problem still existed to a lesser degree.

In Applicant's copending application, U.S. Ser. No. 759,803, filed July 29, 1985, entitled "Electric Valve for Pipe Organs", a new and improved valve member construction was disclosed which eliminated the adverse effects of bounce while facilitating the opening of the valve by means of relatively small force. The valve member was comprised of a support member secured to the armature of the solenoid, felt means secured to the support member and a soft pliable sheet of material secured to one of the support members and felt members adjacent the periphery thereof with sufficient slack to allow separation of the soft pliable member from the felt member whereby the soft pliable member could be maintained in engagement with the valve seat during bouncing movement of the armature.

SUMMARY OF THE INVENTION

The present invention provides a new and improved pipe organ valve having a simplified, light weight, flexible construction which minimizes inertia while permitting flexibility to absorb energy and thereby eliminates undesirable bouncing of the valve member upon closure of a wind chest aperture.

The present invention provides a new and improved pipe organ valve comprised of a soft flexible membrane in the form of a disk adapted to be secured to a suitable actuator, such as the armature of a solenoid adjacent the center of the disk and a semi-rigid ring member secured to the perimeter of the disk to maintain the disk taut while permitting flexing of the ring transversely to the plane of said ring member and permitting distortion of the ring member from its normal plane. The valve member is extremely light weight and has virtually no inertia and will remain in stationary engagement with the valve seat while the armature is allowed to move up and down while its energy is being gradually absorbed by the resiliency of the membrane. By offsetting the center line of the force from a solenoid trying to open the valve from the center line of the force keeping the valve closed, the valve member will be caused to open its leading side before its lagging side to obtain a softer attack of air rushing into the pipe.

The foregoing and other objects, features and advantages of the invention will be apparent from the following more particular description of a preferred embodiment of the invention as illustrated in the accompanying drawings.

BRIEF DESCRIPTION OF THE DRAWINGS

FIG. 1 is a schematic side elevation view, partly in section, showing the valve member according to the present invention in closed position relative to the aperture in the top board of the wind chest.

FIGS. 2 and 3 are views similar to FIG. 1 showing the extreme oscillating positions of the membrane of the valve member as the membrane absorbs the inertia of the armature.

FIG. 4 is a view similar to FIG. 1 showing the center line of the disk being offset from the center line of the pipe hole to facilitate the gradual opening of the valve member.

FIG. 5*a* shows a separate valve seat member surrounding the pipe hole for engagement by the valve member.

FIG. 5*b* shows a modified form of a separate valve seat and a modified valve member construction.

FIG. 6 is a schematic view similar to FIG. 1 showing the manner of lifting the armature to the valve member for larger diameter pipe holes.

DETAILED DESCRIPTION OF THE INVENTION

A pipe organ valve assembly 10 of the present invention is shown in FIG. 1 wherein the top wall 12 of the wind chest is provided with an air passage 14 having an enlarged beveled seat 16 surrounding the upper end thereof for receiving the foot of an organ pipe (not shown). The valve assembly 10 is mounted within the interior 18 of the chest, which has not been shown in its entirety, by any suitable means. The interior 18 of the chest is maintained at a higher pressure than the atmospheric pressure outside of the chest and air is prevented from entering a pipe through the air passage 14 by means of a valve member 20 which is secured to an armature 22 mounted for vertical reciprocating movement within the electric coil 24. A spring 26 normally biases the valve member 20 into sealing engagement with a valve seat surrounding the air passage 14. When it is desired to admit air to a specific pipe the solenoid 24 associated with that pipe is energized thereby drawing the armature 22 downwardly against the force of the spring 23 to move the valve member 20 away from the valve seat thereby allowing pressurized air from the interior of the chest to enter the pipe through the air passage 14.

As discussed above the biggest problem associated with the prior art valve members is the fact that they tend to bounce upon engagement with the valve seat thereby allowing additional undesirable air to enter the pipe through the air passage. The valve member 20 according to the present invention is formed from a laminated construction which will allow the valve member to remain in sealing engagement with the valve seat while the central portion of the valve member oscillates to absorb the inertial forces of the armature. The valve member 20 is comprised of a two ply disk having an outer ply 30 of soft stretchable leather adapted to engage the valve seat 28 and a flexible substantially non-stretchable inner fabric layer 32 which are cemented together over the entire surface area thereof. A semi-rigid ring 34 of plastic or metal is secured to the perimeter of the inner fabric disk 32 by a suitable adhesive. Thus the composite valve member is extremely light weight and has virtually no inertia upon being moved in the closing direction which would create a bounce effect.

A closing operation of the valve member is illustrated in FIGS. 2 and 3. Upon deenergization of the solenoid the armature 22 will move the valve member 20 into sealing engagement with the valve seat 28 under the influence of the spring 26, which is not shown in FIG. 2. The inertia imparted to the armature 22 will cause the armature to force the central part of the composite disk into the air passage 14. The restraining force of the composite disk 30, 32 will cause the armature 22 to rebound as shown in FIG. 3, but since the air pressure is acting on the peripheral portion of the valve member 20, the peripheral portion of the composite disk 30, 32 and the ring 34 is firmly held against the valve seat 28 and the central portion of the composite disk 30, 32, will be bowed inwardly. Several oscillations of the armature may take place before the inertia of the armature is totally absorbed by the valve member 20, but the sealing engagement of the valve member 20 with the valve seat 28 will never be broken.

For some pipes, such as a reed pipe, it is desirable to cause an immediate inrush of air for what is known in the field as a "fast attack". In these instances the axis of the armature 22 would be coaxial with the axis of the air passage 14 so that upon energization of the coil 24 the valve member 20 will be disengaged from the valve seat 28 simultaneously about the entire periphery of the valve seat 28.

In other cases, such as with a flute pipe, it is at times desirable to soften the attack or slow down the inrush of air. This can be accomplished by offsetting the center line or axis of the armature 22 from the center line or axis of the air passage 14, as shown in FIG. 4. Thus the force of the solenoid trying to open the valve member 20 is offset from the center of the force created by the air pressure within the chest which is tending to force the valve member 20 into closed position relative to the valve seat. Due to the offset forces one side of the valve member 20 opens before the other side, as shown in FIG. 4, thereby softening the attack by reducing the initial rush of air into the pipe.

In the embodiments shown in FIGS. 1–4, inclusive, the inside surface of the top wall 12 of the air chest surrounding each air passage 14 defines a valve seat. As shown in FIG. 5*a* the valve seat is defined by an annular ring 40 having an L-shaped cross sectional configuration which is secured to the interior surface of the top wall 12 about the air passage 14 by means of screws 42. In a similar manner the valve seat could be defined by an annular ring 44 having a cross sectional configuration as shown in FIG. 5*b* which is secured partially within the air passage 14 by any suitable means such as an adhesive means such as adhesive, nails, screws, or the like. The quarter round configuration of the valve seat in FIG. 5*b* will facilitate the flow of air as shown by by the arrows thereby creating an additional force on the valve member tending to open the valve. The valve member 20' in FIG. 5*b* is provided with a rigid cross bar 56 of any suitable material which is secured to the ring 34 by an adhesive or the like. The armature 22 is then secured to the cross bar 56 instead of the composite disk to prevent tearing of the disk. The valve seats 40 and 44 may be of plastic, metal, or any suitable material which will provide a smooth surface for engagement with the soft leather face of the valve member 20. The principle of operation with the separate valve seats is the same as described above with respect to FIGS. 2 and 3.

While the valve member 20 is secured directly to the armature 22 by means of a screw 48, in FIGS. 1–5, wherein the screw head has a diameter substantially equal to the diameter of the armature 22, it is sometimes preferable to sandwich the composite disk 30, 32, between two washers 50 and 52, as shown in FIG. 6 for larger diameter air passages 14' in order to distribute the force applied by the armature 22 at the connecting point to the valve member 20 over a larger surface to prevent the composite disk 30, 32, from tearing. It is also possible to increase the thickness of the composite disk 30, 32 separately or in combination with the washers 50, 52.

By using an armature 22 having a substantial degree of mass the inertia of the armature as it moves in the opening direction of the valve under the influence of the solenoid coil 54 will provide a large assist in moving the valve member away from the valve seat. Although the present invention is not limited to the use of a solenoid operated valve and can be operated by other arrangements than as illustrated and described above, the operating member, which would be equivalent to the armature 22, should have sufficient mass so that the inertia of the member will be sufficient to break the air seal between the valve member and the valve seat.

While a valve disk comprised of soft stretchable leather and a relatively non-stretchable fabric other combinations of materials or a disk comprised of a single material having the desired characteristics can also be used. No matter what choice of materials is used the requisite characteristics are for a valve member which will provide a good sealing function while being light weight and flexible to absorb the inertia of the armature during a closing operation. By using a flexible material for the disk portion of the valve member 20 the valve member will be freely tiltable on the end of the armature to readily accommodate itself to the valve seat and to allow the differential opening characteristic as described above with respect to FIG. 4.

While the invention has been particularly shown and described with reference to preferred embodiments thereof it will be understood by those in the art that the foregoing and other changes in form and details may be made therein without departing from the spirit and scope of the invention.

What is claimed is:

1. A pipe organ valve adapted to be mounted in the wind chest of a pipe organ for controlling the flow of air to an air pipe through an air passage in the top of the wind chest comprising an electromagnetic coil, an armature moveable relative to said coil, a valve member secured to said coil, spring means adapted to normally bias said valve member into engagement with a valve seat surrounding said air passage; said valve member being comprised of a disk of flexible, soft material and an annular ring of semi rigid flexible material normally disposed in a flat plane and secured about the periphery of said disk on the side thereof opposite the side of the disk adapted to engage the valve seat whereby the disk can flex in opposite directions relative to the plane of the ring on movement of the valve member into engagement with the valve seat to gradually absorb the inertia of the armature to prevent bounce of the valve member relative to the valve seat.

2. A pipe organ valve as set forth in claim 1 wherein said disk is a composite of a disk of soft resilient leather material and a disk of woven fabric material bonded together.

3. A pipe organ valve as set forth in claim 2 further comprising a rigid cross bar secured diametrically to said annular ring with said armature being secured to said cross bar adjacent the mid point thereof.

4. A pipe organ valve as set forth in claim 1 wherein said disk is secured to said armature adjacent the center of said disk whereby the disk is freely tiltable relative to the armature due to the flexibility of the disk.

5. In a wind chest for a pipe organ of the type having a plurality of cylindrical air passages in the upper surface thereof adapted to be in communication with the pipes of said organ and valve means associated with each of said air passages to control the flow of air from the chest to the pipes, the improvement comprising each of said valve means having a valve member and means for moving said valve member into and out of engagement with said valve seat surrounding an air passage, said valve member being comprised of a flexible soft disk of material and an annular ring of semi rigid flexible material normally disposed in a flat plane and secured about the periphery of said disk on the side opposite the side of the disk adapted to engage the valve seat whereby the disk can flex in opposite directions relative to the plane of the ring upon movement of the valve member into engagement with the valve seat to gradually absorb the inertia of the armature to prevent bounce of the valve member relative to the valve seat.

6. In a wind chest for a pipe organ as set forth in claim 5, the improvement further comprising said disk being a composite of a disk of soft resilient leather material and a disk of woven fabric material bonded together.

7. In a wind chest for a pipe organ as set forth in claim 6, the improvement further comprising said valve means being mounted adjacent an air passage with the center of said disk being offset from the axis of said cylindrical air passage.

8. In a wind chest for a pipe organ as set forth in claim 6, the improvement further comprising a rigid cross bar secured diametrically to said annular ring with said armature being secured to said cross bar adjacent the midpoint thereof.

9. In a wind chest for a pipe organ as set forth in claim 6, the improvement further comprising said valve means being mounted adjacent an air passage with the center of said disk being in alignment with the axis of the cylindrical air passage.

10. In a wind chest for a pipe organ as set forth in claim 5, the improvement further comprising said disk being secured to said armature adjacent the center of said disk whereby the disk is freely tiltable relative to the armature due to the flexibility of the disk.

11. In a wind chest for a pipe organ as set forth in claim 5, the improvement further comprising a separate annular valve seat member secured to said wind chest about said air passage for engagement by said valve member.

12. In a wind chest for a pipe organ as set forth in claim 11, the improvement further comprising said annular valve seat member having a central cylindrical passage therethrough having an axis parallel to the axis of the air passage with the outer periphery of the annular valve seat having a quarter-round cross sectional configuration.

* * * * *